US008529828B2

(12) United States Patent
Cooper

(10) Patent No.: US 8,529,828 B2
(45) Date of Patent: Sep. 10, 2013

(54) MOLTEN METAL PUMP COMPONENTS

(76) Inventor: Paul V. Cooper, Chesterland, OH (US)

( * ) Notice: Subject to any disclaimer, the term of this patent is extended or adjusted under 35 U.S.C. 154(b) by 0 days.

(21) Appl. No.: 12/264,416

(22) Filed: Nov. 4, 2008

(65) Prior Publication Data

US 2009/0054167 A1 Feb. 26, 2009

Related U.S. Application Data

(60) Division of application No. 10/773,105, filed on Feb. 4, 2004, now Pat. No. 7,470,392, which is a continuation of application No. 10/619,405, filed on Jul. 14, 2003, now Pat. No. 7,507,367, and a continuation of application No. 10/620,318, filed on Jul. 14, 2003, now Pat. No. 7,731,891.

(60) Provisional application No. 60/395,471, filed on Jul. 12, 2002.

(51) Int. Cl.
*F04B 17/00* (2006.01)

(52) U.S. Cl.
USPC ..... 266/239; 428/544

(58) Field of Classification Search
USPC ..... 266/239; 428/544
See application file for complete search history.

(56) References Cited

U.S. PATENT DOCUMENTS 35,604 A 6/1862 Guild
116,797 A 7/1871 Barnhart
209,219 A 10/1878 Bookwalter
251,104 A 12/1881 Finch
364,804 A 6/1887 Cole (Continued)

FOREIGN PATENT DOCUMENTS

CA 683469 3/1964
CA 2115929 8/1992

(Continued)

OTHER PUBLICATIONS

"Response to Final Office Action and Request for Continued Examination for U.S. Appl. No. 09/275,627," Including Declarations of Haynes and Johnson, Apr. 16, 2001.

(Continued)

*Primary Examiner* — Scott Kastler
(74) *Attorney, Agent, or Firm* — Snell & Wilmer L.L.P.

(57) ABSTRACT

Improved components for a molten metal pump include a coupling for connecting a rotor shaft to a motor shaft, a rotor shaft and a rotor. The rotor shaft has a first end and a second end wherein the first end optionally has a vertical keyway formed in the outer surface of the shaft. The second end optionally has flat, shallow threads. The coupling can be one-piece or multi-piece, includes a cavity for receiving the first end of the rotor shaft and, if the first end of the rotor shaft has a keyway, the coupling includes a projection in the cavity for being received at least partially in the keyway. The rotor includes a connective portion that connects to the second end of the rotor shaft. If the second end of the rotor shaft includes flat, shallow threads, the connective portion is essentially a bore having flat, shallow threads configured to receive the second end of the rotor shaft. Optionally, the first end of the rotor shaft may have flat, shallow threads in which case the coupling would have a cavity that receives the first end of the rotor shaft, wherein the cavity has flat, shallow threads.

22 Claims, 14 Drawing Sheets

(56) References Cited

U.S. PATENT DOCUMENTS 495,760 A 4/1893 Seitz
506,572 A 10/1893 Wagener
585,188 A 6/1897 Davis
757,932 A 4/1904 Jones
882,477 A 3/1908 Neumann
882,478 A 3/1908 Neumann
890,319 A 6/1908 Wells
898,499 A 9/1908 O'Donnell
909,774 A 1/1909 Flora
919,194 A 4/1909 Livingston
1,037,659 A 9/1912 Rembert
1,100,475 A 6/1914 Franckaerts
1,196,758 A 9/1916 Blair
1,331,997 A 2/1920 Neal
1,377,101 A 5/1921 Sparling
1,380,798 A 6/1921 Hansen et al.
1,439,365 A 12/1922 Hazell
1,454,967 A 5/1923 Gill
1,470,607 A 10/1923 Hazell
1,513,875 A 11/1924 Wilke
1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,038,221 A 4/1936 Kagi
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Heuer
2,300,688 A 11/1942 Nagle
2,304,849 A 12/1942 Ruthman
2,368,962 A 2/1945 Blom
2,383,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 9/1951 Jacobs
2,625,720 A 1/1953 Ross
2,626,086 A 1/1953 Forrest
2,676,279 A * 4/1954 Wilson ..... 310/75 D
2,677,609 A 5/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,832,292 A 4/1958 Edwards
2,853,019 A 9/1958 Thorton
2,865,618 A 12/1958 Abell
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A 8/1962 Sweeney et al.
3,070,393 A 12/1962 Silverberg et al.
3,092,030 A 6/1963 Wunder
3,099,870 A 8/1963 Seeler
3,130,678 A 4/1964 Chenault
3,130,679 A 4/1964 Sence
3,171,357 A 3/1965 Egger
3,203,182 A 8/1965 Pohl
3,227,547 A 1/1966 Szekely
3,244,109 A 4/1966 Barske
3,251,676 A 5/1966 Johnson
3,255,702 A 6/1966 Gehrm
3,258,283 A 6/1966 Winberg et al.
3,272,619 A 9/1966 Sweeney et al.
3,289,473 A 12/1966 Louda
3,291,473 A 12/1966 Sweeney et al.
3,374,943 A * 3/1968 Cervenka ..... 418/83
3,400,923 A 9/1968 Howie et al.
3,417,929 A 12/1968 Secrest et al.
3,432,336 A 3/1969 Langrod
3,459,133 A 8/1969 Scheffler
3,459,346 A 8/1969 Tinnes
3,477,383 A 11/1969 Rawson et al.
3,487,805 A 1/1970 Satterthwaite
1,185,314 A 3/1970 London
3,512,762 A 5/1970 Umbricht
3,512,788 A 5/1970 Kilbane
3,737,305 A 12/1970 Blayden et al.
3,561,885 A 2/1971 Lake
3,575,525 A 4/1971 Fox et al.
3,618,917 A 11/1971 Fredrikson
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden
3,743,263 A 7/1973 Szekely
3,743,500 A 7/1973 Foulard et al.
3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,941,588 A 3/1976 Dremann
3,941,589 A 3/1976 Norman et al.
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,972,709 A 8/1976 Chia et al.
3,976,286 A 8/1976 Thompson et al.
3,984,234 A 10/1976 Claxton et al.

3,985,000 A 10/1976 Hartz
3,997,336 A 12/1976 van Linden et al.
4,003,560 A 1/1977 Carbonnel
4,008,884 A 2/1977 Fitzpatrick et al.
4,018,598 A 4/1977 Markus
4,052,199 A 10/1977 Mangalick
4,055,390 A 10/1977 Young
4,063,849 A 12/1977 Modianos
4,068,965 A 1/1978 Lichti
4,091,970 A 5/1978 Kimiyama et al.
4,119,141 A 10/1978 Thut et al.
4,126,360 A 11/1978 Miller et al.
4,128,415 A 12/1978 van Linden et al.
4,144,562 A 3/1979 Cooper
4,169,584 A 10/1979 Mangalick
4,191,486 A 3/1980 Pelton
4,192,011 A 3/1980 Cooper et al.
4,213,091 A 7/1980 Cooper
4,213,176 A 7/1980 Cooper
4,213,742 A 7/1980 Henshaw
4,219,882 A 8/1980 Cooper et al.
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,456,974 A 6/1984 Cooper
4,470,846 A 9/1984 Dube
4,474,315 A 10/1984 Gilbert et al.
4,489,475 A 12/1984 Struttmann
4,496,393 A 1/1985 Lustenberger
4,504,392 A 3/1985 Groteke
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,592,700 A 6/1986 Toguchi et al.
4,593,597 A 6/1986 Albrecht et al.
4,594,052 A 6/1986 Niskanen
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,651,806 A 3/1987 Allen et al.
4,655,610 A 4/1987 Al-Jaroudi
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
390,319 A 10/1988 Thomson
4,786,230 A 11/1988 Thut
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,908,060 A 3/1990 Duenkelmann
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara et al.
4,989,736 A 2/1991 Andersson et al.
5,006,232 A 4/1991 Lidgitt et al.
5,015,518 A * 5/1991 Sasaki et al. ..... 428/192
5,025,198 A 6/1991 Mordue et al.
5,028,211 A 7/1991 Mordue et al.
5,029,821 A 7/1991 Bar-on et al.
5,049,841 A 9/1991 Cooper et al.
5,078,572 A 1/1992 Amra et al.
5,080,715 A 1/1992 Provencher et al.
5,088,893 A 2/1992 Gilbert et al.
5,092,821 A 3/1992 Gilbert et al.
5,098,134 A 3/1992 Monckton
5,099,554 A 3/1992 Cooper
5,114,312 A 5/1992 Stanislao
5,126,047 A 6/1992 Martin et al.
5,131,632 A 7/1992 Olson
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,172,458 A 12/1992 Cooper
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.

5,489,734 A 2/1996 Nagel et al.
5,491,279 A 2/1996 Robert et al.
5,495,746 A 3/1996 Sigworth
5,505,143 A 4/1996 Nagel
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwan et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klein
5,735,935 A 4/1998 Areaux
5,741,422 A 4/1998 Eichenmiller et al.
5,744,117 A 4/1998 Wilkinson et al.
5,745,861 A 4/1998 Bell et al.
5,755,847 A 5/1998 Quayle
5,772,324 A 6/1998 Falk
5,776,420 A 7/1998 Nagel
5,785,494 A 7/1998 Vild et al.
5,805,067 A 9/1998 Bradley et al.
5,810,311 A 9/1998 Davison et al.
5,836,314 A 11/1998 Benderev et al.
5,842,832 A 12/1998 Thut
5,858,059 A 1/1999 Abramovich et al.
5,863,314 A 1/1999 Morando
5,864,316 A 1/1999 Bradley et al.
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,949,369 A 9/1999 Bradley et al.
5,951,243 A 9/1999 Cooper
5,963,580 A 10/1999 Eckert
5,992,230 A * 11/1999 Scarpa et al. ..... 73/261
5,993,726 A 11/1999 Huang
5,993,728 A 11/1999 Vild
5,995,041 A 11/1999 Bradley et al.
6,019,576 A 2/2000 Thut
6,024,286 A 2/2000 Bradley et al.
6,027,685 A 2/2000 Cooper
6,036,745 A 3/2000 Gilbert et al.
6,074,455 A 6/2000 van Linden et al.
6,082,965 A 7/2000 Morando
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller et al.
6,243,366 B1 6/2001 Bradley et al.
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 3/2002 Morando
6,358,467 B1 3/2002 Mordue
6,371,723 B1 4/2002 Grant et al.
6,398,525 B1 * 6/2002 Cooper ..... 417/423.6
6,439,860 B1 * 8/2002 Greer ..... 417/360
6,451,247 B1 9/2002 Mordue et al.
6,457,940 B1 10/2002 Lehman
6,457,950 B1 10/2002 Cooper et al.
6,464,458 B2 10/2002 Vild et al.
6,464,459 B2 10/2002 Vild
6,495,948 B1 12/2002 Garrett, III
6,497,559 B1 12/2002 Grant
6,500,228 B1 12/2002 Klingensmith et al.
6,503,292 B2 1/2003 Klingensmith et al.
6,524,066 B2 2/2003 Thut
6,533,535 B2 3/2003 Thut
6,551,060 B2 4/2003 Mordue et al.
6,562,286 B1 5/2003 Lehman
6,648,026 B2 11/2003 Look et al.
6,679,936 B2 1/2004 Quackenbush
6,689,310 B1 2/2004 Cooper
6,695,510 B1 2/2004 Look et al.
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,902,696 B2 6/2005 Klingensmith et al.
6,955,489 B2 10/2005 Look et al.
7,056,322 B2 6/2006 Davison et al.
7,083,758 B2 8/2006 Tremblay
7,131,482 B2 11/2006 Vincent et al.
7,157,043 B2 1/2007 Neff
7,279,128 B2 10/2007 Kennedy et al.
7,326,028 B2 2/2008 Morando
7,402,276 B2 7/2008 Cooper
7,470,392 B2 12/2008 Cooper
7,476,357 B2 1/2009 Thut
7,497,988 B2 3/2009 Thut
7,507,367 B2 3/2009 Cooper
8,110,141 B2 2/2012 Cooper
2001/0000465 A1 4/2001 Thut
2001/0012758 A1 8/2001 Bradley et al.
2002/0185794 A1 12/2002 Vincent
2002/0187947 A1 12/2002 Jarai et al.
2003/0047850 A1 3/2003 Areaux
2003/0201583 A1 10/2003 Klingensmith
2004/0050525 A1 3/2004 Kennedy et al.
2004/0076533 A1 4/2004 Cooper
2004/0115079 A1 6/2004 Cooper
2004/0199435 A1 10/2004 Abrams et al.
2004/0262825 A1 12/2004 Cooper
2005/0013713 A1 1/2005 Cooper
2005/0013714 A1 1/2005 Cooper
2005/0013715 A1 1/2005 Cooper
2005/0053499 A1 3/2005 Cooper
2005/0077730 A1 4/2005 Thut
2005/0081607 A1 4/2005 Patel et al.
2005/0116398 A1 6/2005 Tremblay
2006/0180963 A1 8/2006 Thut
2007/0253807 A1 11/2007 Cooper
2008/0213111 A1 9/2008 Cooper
2008/0230966 A1 9/2008 Cooper
2011/0140319 A1 6/2011 Cooper

FOREIGN PATENT DOCUMENTS

| | | | |
|---|---|---|---|
| CA | 2176475 | | 5/1996 |
| CA | 2244251 | | 12/1996 |
| CA | 2305865 | | 2/2000 |
| CH | 392268 | | 9/1965 |
| DE | 1800446 | | 12/1969 |
| EP | 0168250 | A2 | 1/1986 |
| EP | 0665378 | | 2/1995 |
| EP | 1019635 | | 6/2006 |
| GB | 942648 | | 11/1963 |
| GB | 1185314 | | 3/1970 |
| GB | 2217784 | | 3/1989 |
| JP | 58048796 | | 3/1983 |
| JP | 63104773 | | 5/1988 |
| MX | 227385 | | 4/2005 |
| NO | 90756 | | 1/1959 |
| RU | 416401 | | 2/1974 |
| RU | 773312 | | 10/1980 |
| WO | W09808990 | | 3/1998 |
| WO | W09825031 | | 6/1998 |
| WO | 0009889 | | 2/2000 |
| WO | 0212147 | | 2/2002 |

OTHER PUBLICATIONS

Document No. 504217: Excerpts from "Pyrotek Inc.'s Motion for Summary Judgment of Invalidity and Unenforceability of U.S. Appl. No. 07/402,276," Oct. 2, 2009.

Document No. 505026: Excerpts from "MMEI's Response to Pyrotek's Motion for Summary Judgment of Invalidity or Enforceability of U.S. Appl. No. 07/402,276," Oct. 9, 2009.

Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.

Document No. 517158: Excerpts from "Reasoned Award," Feb. 19, 2010.

US 5,961,265, 10/1999, Meneice et al. (withdrawn).

Document No. 525055: Excerpts from "Molten Metal Equipment Innovations, Inc.'s Reply Brief in Support of Application to Confirm Arbitration Award and Opposition to Motion to Vacate," May 12, 2010.

USPTO; Office Action dated Nov. 15, 2007 in U.S. Appl. No. 10/773,101.

USPTO; Office Action dated Mar. 16, 2005 in U.S. Appl. No. 10/827,941.

USPTO; Final Office Action dated Nov. 7, 2005 in U.S. Appl. No. 10/827,941.

USPTO; Office Action dated Jul. 12, 2006 in U.S. Appl. No. 10/827,941.

USPTO; Final Office Action dated Mar. 8, 2007 in U.S. Appl. No. 10/827,941.

USPTO; Office Action dated Oct. 29, 2007 in U.S. Appl. No. 10/827,941.

USPTO; Office Action dated Sep. 26, 2008 in U.S. Appl. No. 11/413,982.

USPTO; Final Office Action dated Oct. 14, 2008 in U.S. Appl. No. 12/111,835.

USPTO; Office Action dated May 15, 2009 in U.S. Appl. No. 12/111,835.

USPTO; Office Action dated Nov. 3, 2008 in U.S. Appl. No. 12/120,200.

USPTO; Final Office Action dated May 28, 2009 in U.S. Appl. No. 12/120,200.

USPTO; Office Action dated Dec. 18, 2009 in U.S. Appl. No. 12/120,200.

USPTO; Final Office Action dated Jul. 9, 2010 in U.S. Appl. No. 12/120,200.

USPTO; Office Action dated Jan. 21, 2011 in U.S. Appl. No. 12/120,200.

USPTO; Final Office Action dated Jul. 26, 2011 in U.S. Appl. No. 12/120,200.

USPTO; Office Action dated Mar. 31, 2009 in U.S. Appl. No. 12/120,190.

USPTO; Final Office Action dated Dec. 4, 2009 in U.S. Appl. No. 12/120,190.

USPTO; Office Action dated Jun. 28, 2010 in U.S. Appl. No. 12/120,190.

USPTO; Final Office Action dated Jan. 6, 2011 in U.S. Appl. No. 12/120,190.

USPTO; Office Action dated Jun. 27, 2011 in U.S. Appl. No. 12/120,190.

USPTO; Office Action dated Apr. 13, 2009 in U.S. Appl. No. 12/264,416.

USPTO; Final Office Action dated Oct. 8, 2009 in U.S. Appl. No. 12/264,416.

USPTO; Office Action dated Feb. 1, 2010 in U.S. Appl. No. 12/264,416.

USPTO; Final Office Action dated Jun. 30, 2010 in U.S. Appl. No. 12/264,416.

USPTO; Office Action dated Mar. 17, 2011 in U.S. Appl. No. 12/264,416.

USPTO; Final Office Action dated Jul. 7, 2011 in U.S. Appl. No. 12/264,416.

USPTO; Office Action dated Apr. 27, 2009 in U.S. Appl. No. 12/146,788.

USPTO; Final Office Action dated Oct. 15, 2009 in U.S. Appl. No. 12/146,788.

USPTO; Office Action dated Feb. 16, 2010 in U.S. Appl. No. 12/146,788.

USPTO; Final Office Action dated Jul. 13, 2010 in U.S. Appl. No. 12/146,788.

USPTO; Office Action dated Apr. 19, 2011 in U.S. Appl. No. 12/146,788.

USPTO; Notice of Allowance dated Aug. 19, 2011 in U.S. Appl. No. 12/146,788.

USPTO; Office Action dated May 22, 2009 in U.S. Appl. No. 12/369,362.

USPTO; Final Office Action dated Dec. 14, 2009 in U.S. Appl. No. 12/369,362.

USPTO; Office Action dated Jun. 16, 2009 in U.S. Appl. No. 12/146,770.

USPTO; Final Office Action dated Feb. 24, 2010 in U.S. Appl. No. 12/146,770.

USPTO; Office Action dated Jun. 9, 2010 in U.S. Appl. No. 12/146,770.

USPTO; Office Action dated Nov. 18, 2010 in U.S. Appl. No. 12/146,770.

USPTO; Final Office Action dated Apr. 4, 2011 in U.S. Appl. No. 12/146,770.

USPTO; Notice of Allowance dated Aug. 22, 2011 in U.S. Appl. No. 12/146,770.

USPTO; Office Action dated Dec. 11, 2009 in U.S. Appl. No. 11/766,617.

USPTO; Office Action dated Mar. 8, 2010 in U.S. Appl. No. 11/766,617.

USPTO; Final Office Action dated Sep. 20, 2010 in U.S. Appl. No. 11/766,617.

USPTO; Office Action dated Mar. 1, 2011 in U.S. Appl. No. 11/766,617.

USPTO; Final Office Action dated Sep. 22, 2011 in U.S. Appl. No. 11/766,617.

USPTO; Final Office Action dated Jun. 11, 2010 in U.S. Appl. No. 12/395,430.

USPTO; Office Action dated Nov. 24, 2010 in U.S. Appl. No. 12/395,430.

USPTO; Final Office Action dated Apr. 6, 2011 in U.S. Appl. No. 12/395,430.

USPTO; Office Action dated Aug. 18, 2011 in U.S. Appl. No. 12/395,430.

USPTO; Office Action dated Sep. 29, 2010 in U.S. Appl. No. 12/758,509.

USPTO; Final Office Action dated May 11, 2011 in U.S. Appl. No. 12/758,509.

USPTO; Office Action dated Sep. 22, 2011 in U.S. Appl. No. 12/880,027.
USPTO; Office Action dated Aug. 25, 2011 in U.S. Appl. No. 13/047,747.
USPTO; Office Action dated Aug. 27, 2001 in U.S. Appl. No. 90/005,910.
CIPO; Office Action dated Dec. 4, 2001 in Application No. 2,115,929.
CIPO; Office Action dated Apr. 22, 2002 in Application No. 2,115,929.
CIPO; Notice of Allowance dated Jul. 18, 2003 in Application No. 2,115,929.
CIPO; Office Action dated Jun. 30, 2003 in Application No. 2,176,475.
CIPO; Notice of Allowance dated Sep. 15, 2004 in Application No. 2,176,475.
CIPO; Office Action dated May 29, 2000 in Application No. 2,242,174.
CIPO; Office Action dated Feb. 22, 2006 in Application No. 2,244,251.
CIPO; Office Action dated Mar. 27, 2007 in Application No. 2,244,251.
CIPO; Notice of Allowance dated Jan. 15, 200 in Application No. 2,244,251.
CIPO; Office Action dated Sep. 18, 2002 in Application No. 2,305,865.
CIPO; Notice of Allowance dated May 2, 2003 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US 1999/18178.
PCT; International Search Report or Declaration dated Oct. 9, 1998 in Application No. PCT/US1999/22440.
USPTO; Office Action dated Feb. 23, 1996 in U.S. Appl. No. 08/439,739.
USPTO; Office Action dated Aug. 15, 1996 in U.S. Appl. No. 08/439,739.
USPTO; Advisory Action dated Nov. 18, 1996 in U.S. Appl. No. 08/439,739.
USPTO; Advisory Action dated Dec. 9, 1996 in U.S. Appl. No. 08/439,739.
USPTO; Notice of Allowance dated Jan. 17, 1997 in U.S. Appl. No. 08/439,739.
USPTO; Office Action dated Jul. 22, 1996 in U.S. Appl. No. 08/489,962.
USPTO; Office Action dated Jan. 6, 1997 in U.S. Appl. No. 08/489,962.
USPTO; Interview Summary dated Mar. 4, 1997 in U.S. Appl. No. 08/489,962.
USPTO; Notice of Allowance dated Mar. 27, 1997 in U.S. Appl. No. 08/489,962.
USPTO; Office Action dated Sep. 23, 1998 in U.S. Appl. No. 08/759,780.
USPTO; Interview Summary dated Dec. 30, 1998 in U.S. Appl. No. 08/789,780.
USPTO; Notice of Allowance dated Mar. 17, 1999 in U.S. Appl. No. 08/789,780.
USPTO; Office Action dated Jul. 23, 1998 in U.S. Appl. No. 08/889,882.
USPTO; Office Action dated Jan. 21, 1999 in U.S. Appl. No. 08/889,882.
USPTO; Notice of Allowance dated Mar. 17, 1999 in U.S. Appl. No. 08/889,882.
USPTO; Office Action dated Feb. 26, 1999 in U.S. Appl. No. 08/951,007.
USPTO; Interview Summary dated Mar. 15,1999 in U.S. Appl. No. 08/951,007.
USPTO; Office Action dated May 17, 1999 in U.S. Appl. No. 08/951,007.
USPTO; Notice of Allowance dated Aug. 27, 1999 in U.S. Appl. No. 08/951,007.
USPTO; Office Action dated Dec. 23, 1999 in U.S. Appl. No. 09/132,934.
USPTO; Notice of Allowance dated Mar. 9, 2000 in U.S. Appl. No. 09/132,934.
USPTO; Office Action dated Jan. 7, 2000 in U.S. Appl. No. 09/152,168.
USPTO; Notice of Allowance dated Aug. 7, 2000 in U.S. Appl. No. 09/152,168.
USPTO; Office Action dated Sep. 29, 1999 in U.S. Appl. No. 09/275,627.
USPTO; Office Action dated May 22, 2000 in U.S. Appl. No. 09/275,627.
USPTO; Office Action dated Nov. 14, 2000 in U.S. Appl. No. 09/275,627.
USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.
USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.
USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.

USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Jun. 27, 2006 in U.S. Appl. No. 10/773,102.
USPTO; Final Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance dated Apr. 18, 2008 in U.S. Appl. No. 10/773,102.
USPTO; Office Action dated Jul. 24, 2006 in U.S. Appl. No. 10/773,105.
USPTO; Final Office Action dated Jul. 21, 2007 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Final Office Action dated Nov. 28, 2011 in U.S. Appl. No. 12/120,190.
USPTO; Notice of Allowance dated Feb. 6, 2012 in U.S. Appl. No. 12/120,190.
USPTO; Final Office Action dated Feb. 3, 2012 in U.S. Appl. No. 12/120,200.
USPTO; Notice of Allowance dated Nov. 1, 2011 in U.S. Appl. No. 12/146,770.
USPTO; Final Office Action dated Dec. 13, 2011 in U.S. Appl. No. 12/395,430.
USPTO; Advisory Action dated Feb. 22, 2012 in U.S. Appl. No. 12/395,430.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Ex Parte Quayle Action dated Jun. 27, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Apr. 19, 2012 in U.S. Appl. No. 12/853,268.
USPTO; Office Action dated May 29, 2012 in U.S. Appl. No. 12/878,984.
USPTO; Final Office Action dated Feb. 16, 2012 in U.S. Appl. No. 12/880,027.
USPTO; Office Action dated Aug. 25, 2011 in U.S. Appl. No. 13/047,719.
USPTO; Final Office Action dated Dec. 16, 2011 in U.S. Appl. No. 13/047,719.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Apr. 18, 2012 in U.S. Appl. No. 13/252,145.
CIPO; Notice of Allowance dated Jan. 15, 2008 in Application No. 2,244,251.

* cited by examiner

MOLTEN METAL PUMP COMPONENTS

CROSS-REFERENCE TO RELATED APPLICATIONS

This application is a divisional application of, and claims priority under 38 U.S.C. §§119 and 120 to U.S. patent application Ser. No. 10/773,105 (Now U.S. Pat. No. 7,470,392), filed Feb. 4, 2004, by Paul V. Cooper which is a continuation application of and claims priority to U.S. patent application Ser. No. 10/619,405 (Now U.S. Pat. No. 7,507,367), filed on Jul. 14, 2003, by Paul V. Cooper, and U.S. patent application Ser. No. 10/620,318 (Now U.S. Pat. No. 7,731,891), filed on Jul. 14, 2003, by Paul V. Cooper both of which claim priority to U.S. Provisional Patent Application Ser. No. 60/395,471 filed Jul. 12, 2002.

FIELD OF THE INVENTION

The invention relates to components used in molten metal pumps, particularly a rotor shaft, a rotor shaft coupling and a connective portion on a rotor to connect to a rotor shaft. The components are designed to facilitate connections while alleviating breakage of the components.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, which are released into molten metal.

Known pumps for pumping molten metal (also called "molten-metal pumps") include a pump base (also called a housing or casing), one or more inlets to allow molten metal to enter a pump chamber (an inlet is usually an opening in the pump base that communicates with the pump chamber), a pump chamber, which is an open area formed within the pump base, and a discharge, which is a channel or conduit communicating with the pump chamber (in an axial pump the pump chamber and discharge may be the same structure or different areas of the same structure) leading from the pump chamber to the molten metal bath in which the pump base is submerged. A rotor, also called an impeller, is mounted in the pump chamber and is connected to a drive shaft. The drive shaft is typically a motor shaft coupled to a rotor shaft, wherein the motor shaft has two ends, one end being connected to a motor and the other end being coupled to the rotor shaft. The rotor shaft also has two ends, wherein one end is coupled to the motor shaft and the other end is connected to the rotor. Often, the rotor shaft is comprised of graphite, the motor shaft is comprised of steel, and these two shafts are coupled by a coupling, which is usually comprised of steel.

As the motor turns the drive shaft, the drive shaft turns the rotor and the rotor pushes molten metal out of the pump chamber, through the discharge, which may be an axial or tangential discharge, and into the molten metal bath. Most molten metal pumps are gravity fed, wherein gravity forces molten metal through the inlet and into the pump chamber as the rotor pushes molten metal out of the pump chamber.

Molten metal pump casings and rotors usually employ a bearing system comprising ceramic rings wherein there are one or more rings on the rotor that align with rings in the pump chamber (such as rings at the inlet (which is usually the top of the pump chamber and bottom of the pump chamber) when the rotor is placed in the pump chamber. The purpose of the bearing system is to reduce damage to the soft, graphite components, particularly the rotor and pump chamber wall, during pump operation. A known bearing system is described in U.S. Pat. No. 5,203,681 to Cooper, the disclosure of which is incorporated herein by reference. As discussed in U.S. Pat. Nos. 5,591,243 and 6,093,000, each to Cooper, the disclosures of which are incorporated herein by reference, bearing rings can cause various operational and shipping problems and U.S. Pat. No. 6,093,000 discloses rigid coupling designs and a monolithic rotor to help alleviate this problem. Further, U.S. Pat. No. 2,948,524 to Sweeney et al., U.S. Pat. No. 4,169,584 to Mangalick, U.S. Pat. No. 5,203,681 to Cooper and U.S. Pat. No. 6,123,523 to Cooper (the disclosures of the afore-mentioned patents to Cooper, insofar as such disclosures are not inconsistent with the teachings of this application, are incorporated herein by reference) all disclose molten metal pumps. Furthermore, copending U.S. patent application Ser. No. 12/146,770 to Paul V. Cooper, filed on Jun. 26, 2008 and entitled "Pump With Rotating Inlet" discloses, among other things, a pump having an inlet and rotor structure (or other displacement structure) that rotate together as the pump operates in order to alleviate jamming. The disclosure of this copending application, insofar as such disclosures are not inconsistent with the teachings of this application, is incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of a charging well where scrap metal is charged (i.e., added).

Transfer pumps are generally used to transfer molten metal from the external well of a reverbatory furnace to a different location such as a ladle or another furnace. Examples of transfer pumps are disclosed in U.S. Pat. No. 6,345,964 B1 to Cooper, the disclosure of which, insofar as such disclosures are not inconsistent with the teachings of this application, is incorporated herein by reference, and U.S. Pat. No. 5,203,681.

Gas-release pumps, such as gas-injection pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber. A system for releasing gas into a pump chamber is disclosed in U.S. Pat. No. 6,123,523 to Cooper. Another gas-release pump is disclosed in a co-pending U.S. Patent Application filed on Feb. 4, 2004 and entitled "System for Releasing Gas Into Molten Metal" to Paul V. Cooper, the disclosure of which that is not inconsistent with the teachings of this application is incorporated herein by reference.

A problem with known molten metal pumps is that machining the graphite components, such as the rotor and rotor shaft, can create weak points that may break during operation. For example, it is known to machine threads into an end of a rotor shaft in order for the end to be received in the threaded bore of a coupling so that the coupling (connected to a motor shaft at the end opposite the rotor shaft) can drive the rotor shaft. The threads formed in the end of the rotor shaft are typically pointed and create weak areas that can cause the rotor shaft to break during operation. A similar type of threaded connection is often used to connect the rotor shaft to the rotor. Further, it is known to machine an end of the rotor shaft to create opposing flat surfaces that are received in the coupling. Removing this material from the end of the rotor shaft also weakens the shaft and can cause breakage.

SUMMARY OF THE INVENTION

The present invention includes improved rotor shafts, and a coupling and rotor that can be used with one or more of the improved rotor shafts. One rotor shaft according to the invention has a first end for connecting to a coupling and a second end for connecting to a rotor. The first end has an outer surface, preferably having a generally annular outer wall, and a vertical keyway formed in the outer surface. The first end is received in a cavity of a coupling wherein the cavity includes a projection that is received at least partially in the keyway and the projection applies driving force to the rotor shaft as the coupling turns.

Another rotor shaft according to the invention has a second end including flat, shallow threads, rather than threads that end in a point (also referred to herein as "pointed threads"). This shaft is used with a rotor having a connective portion, wherein the connective portion is a bore that also includes flat, shallow threads and the second end of the rotor shaft is received in the connective portion.

A rotor shaft according to the invention may also have both a first end and a second end as described above. Further, a rotor shaft according to the invention may have a first end with shallow, flat threads that is used with a coupling having shallow, flat threads to receive the first end.

Also disclosed herein are a coupling and rotor that may be used with one or more rotor shafts according to the invention and pumps including one or more of the improved components.

DETAILED DESCRIPTION OF A PREFERRED EMBODIMENT

Figure 1:
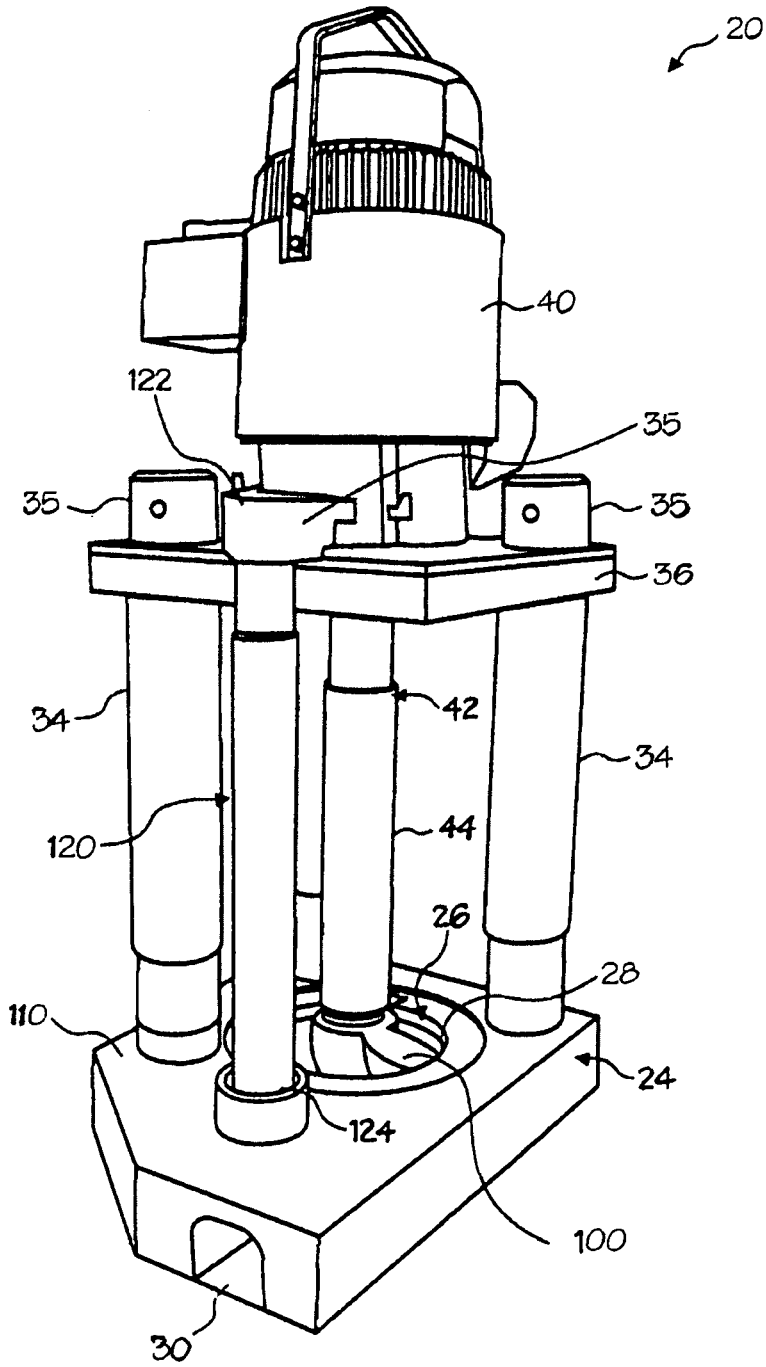
FIG. 1 is a perspective view of a pump for pumping molten metal.

Referring now to the drawing where the purpose is to illustrate and describe different embodiments of the invention, and not to limit same, FIG. 1 shows a molten metal pump. During operation, Pump 20 is usually positioned in a molten metal bath B in a pump well, which is normally part of the open well of a reverbatory furnace.

The components of pump 20 that are exposed to the molten metal are preferably formed of structural refractory materials, which are resistant to degradation in the molten metal. Carbonaceous refractory materials, such as carbon of a dense or structural type, including graphite, graphitized carbon, clay-bonded graphite, carbon-bonded graphite, or the like have all been found to be most suitable because of cost and ease of machining. Such components may be made by mixing ground graphite with a fine clay binder, forming the non-coated component and baking, and may be glazed or unglazed. In addition, components made of carbonaceous refractory materials may be treated with one or more chemicals to make the components more resistant to oxidation. Oxidation and erosion treatments for graphite parts are practiced commercially, and graphite so treated can be obtained from sources known to those skilled in the art.

Pump 20 can be any structure or device for pumping or otherwise conveying molten metal, such as one of the pumps disclosed in U.S. Pat. No. 5,203,681 to Cooper, copending U.S. Patent Application to Cooper entitled "Pump with Rotating Inlet" or copending U.S. Patent Application to Cooper entitled "System for Releasing Gas Into Molten Metal." The invention could also use an axial pump having an axial, rather than tangential, discharge. Preferred pump 20 has a pump base 24 for being submersed in a molten metal bath. Pump base 24 preferably includes a generally nonvolute pump chamber 26, such as a cylindrical pump chamber or what has been called a "cut" volute, although pump base 24 may have any shape pump chamber suitable of being used, including a volute-shaped chamber. Chamber 26 may be constructed to have only one opening, either in its top or bottom, if a tangential discharge is used, since only one opening is required to introduce molten metal into pump chamber 26. Generally, pump chamber 24 has two coaxial openings of the same diameter and usually one is blocked by a flow blocking plate mounted on the bottom of, or formed as part of, a device or rotor 100. (In the context of this application, "rotor" refers to any rotor that may be used to displace molten metal, and includes a device having a rotating inlet structure).

Figure 1A:
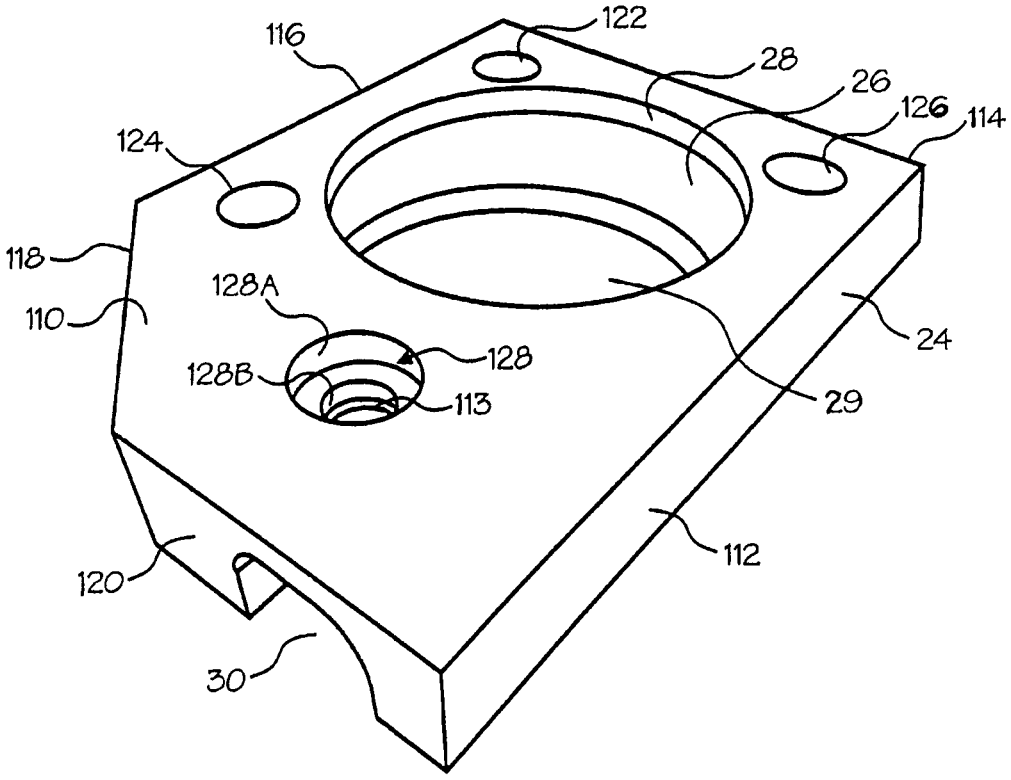
FIG. 1*a* is a perspective view of the pump base of the pump of FIG. 1.
Figure 2:
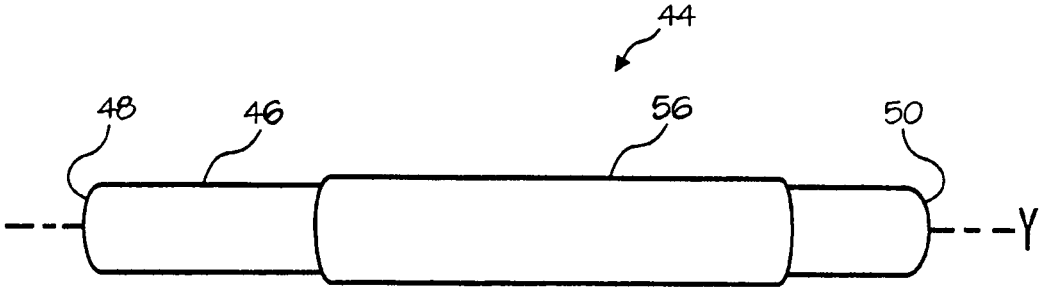
FIG. 2 is a side view of a rotor shaft according to the invention.
Figure 3:
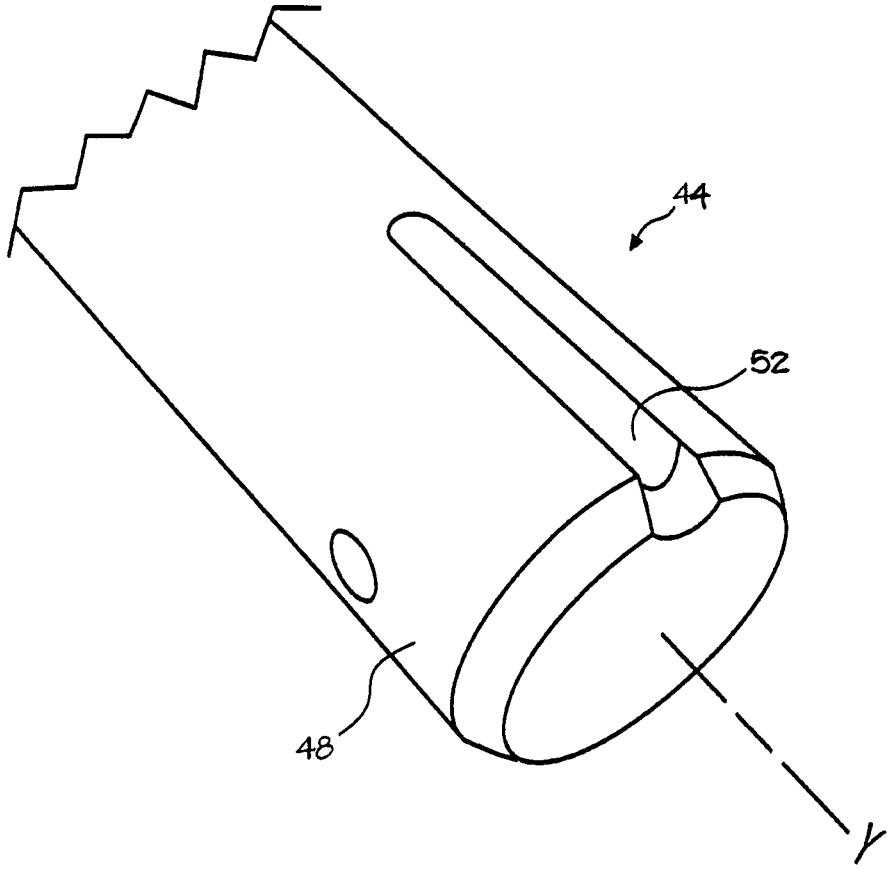
FIG. 3 is a perspective view of one end of the rotor shaft of FIG. 2 showing a keyway.
Figure 4:
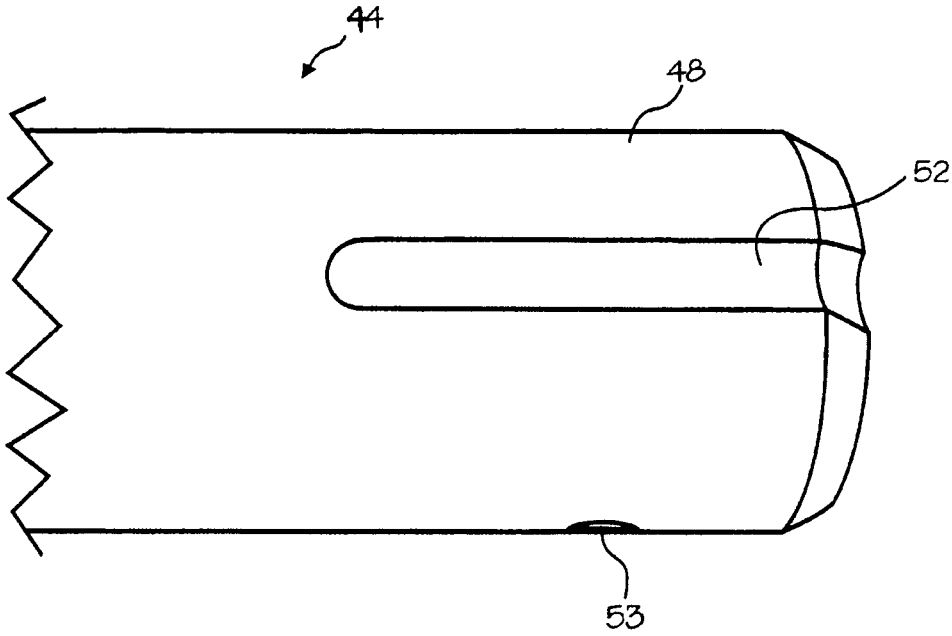
FIG. 4 is side view of the end of the rotor shaft shown in FIG. 3.
Figure 5:
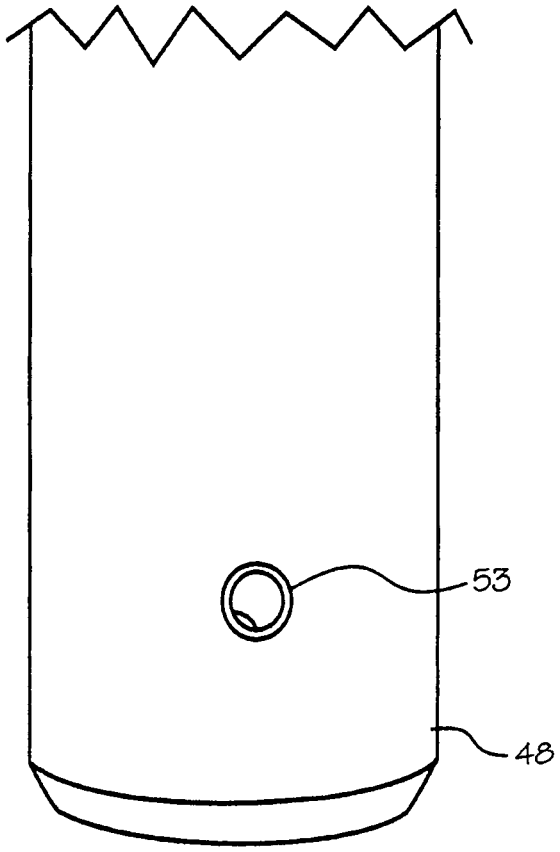
FIG. 5 is a side view of the end of the rotor shaft shown in FIGS. 3 and 4, wherein the rotor shaft has been rotated to show a through bolt hole.
Figure 6:
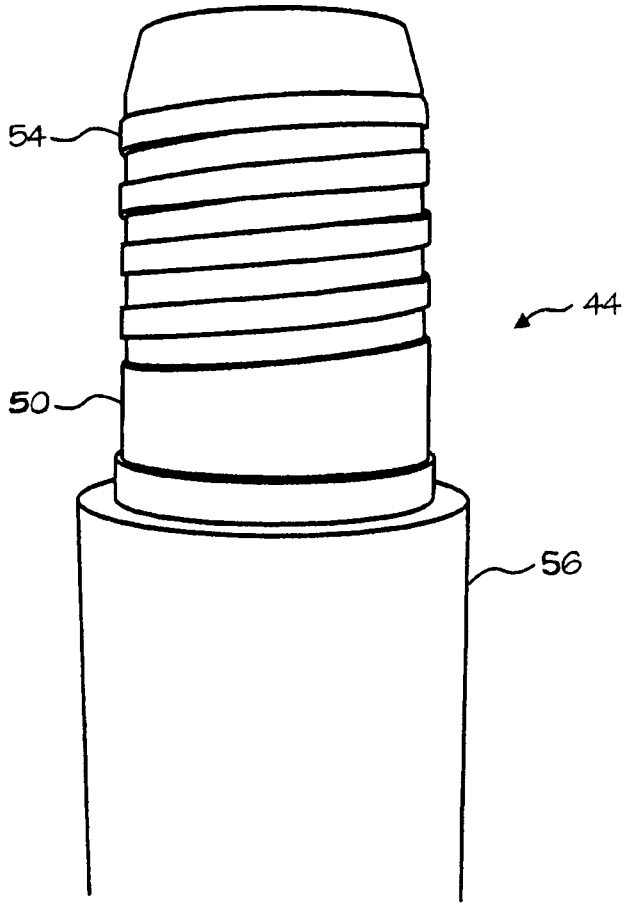
FIG. 6 is a side view of the end of the rotor shaft shown in FIG. 2, wherein the end is opposite the end shown in FIGS. 3-5.
Figure 7:
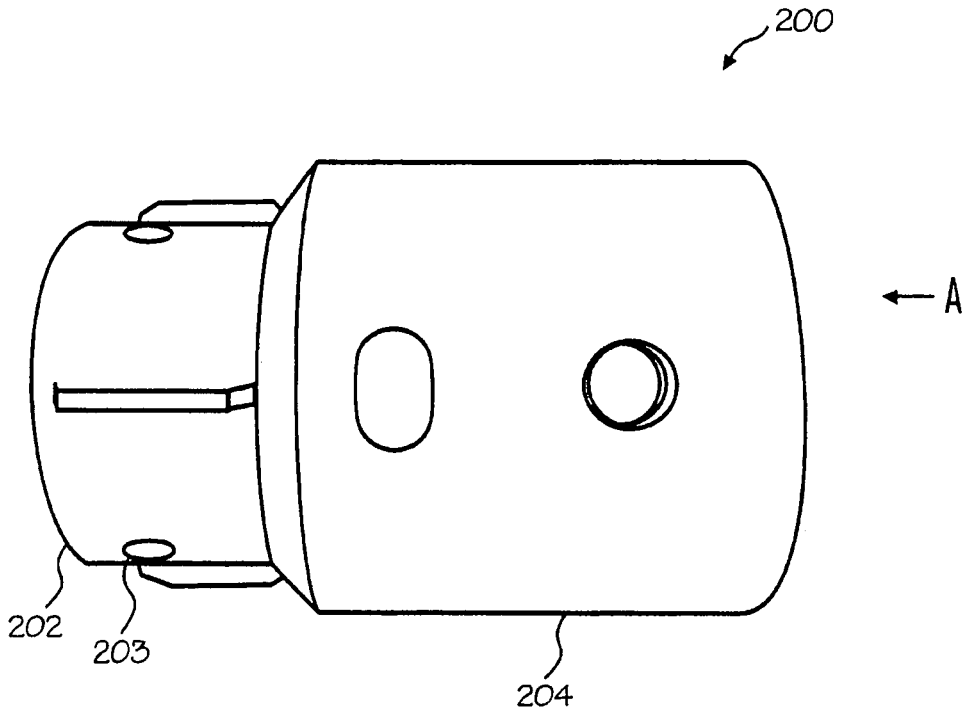
FIG. 7 is a side view of a coupling according to the invention.
Figure 8:
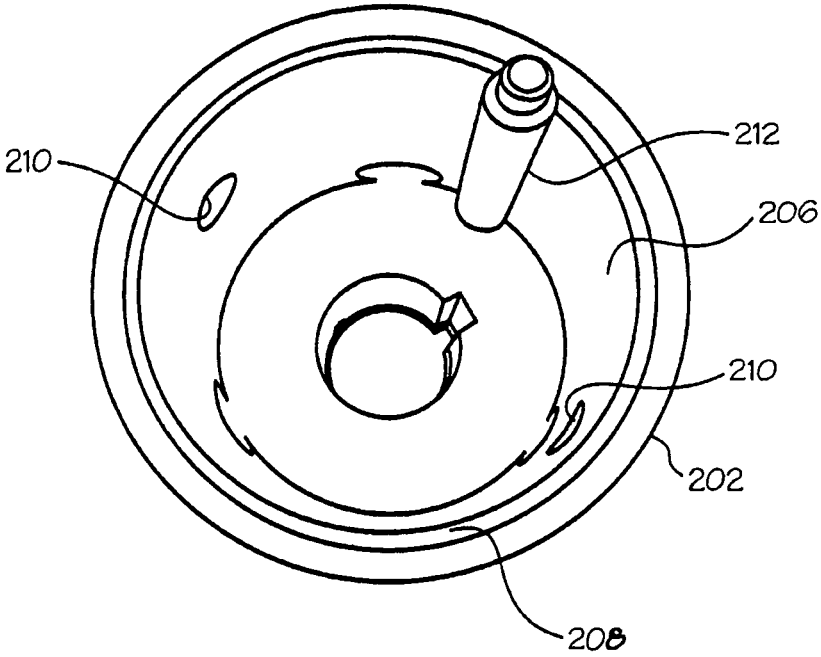
FIG. 8 is a bottom, perspective view of the coupling of FIG. 7 as seen from the vantage of arrow A on FIG. 7.
Figure 9:
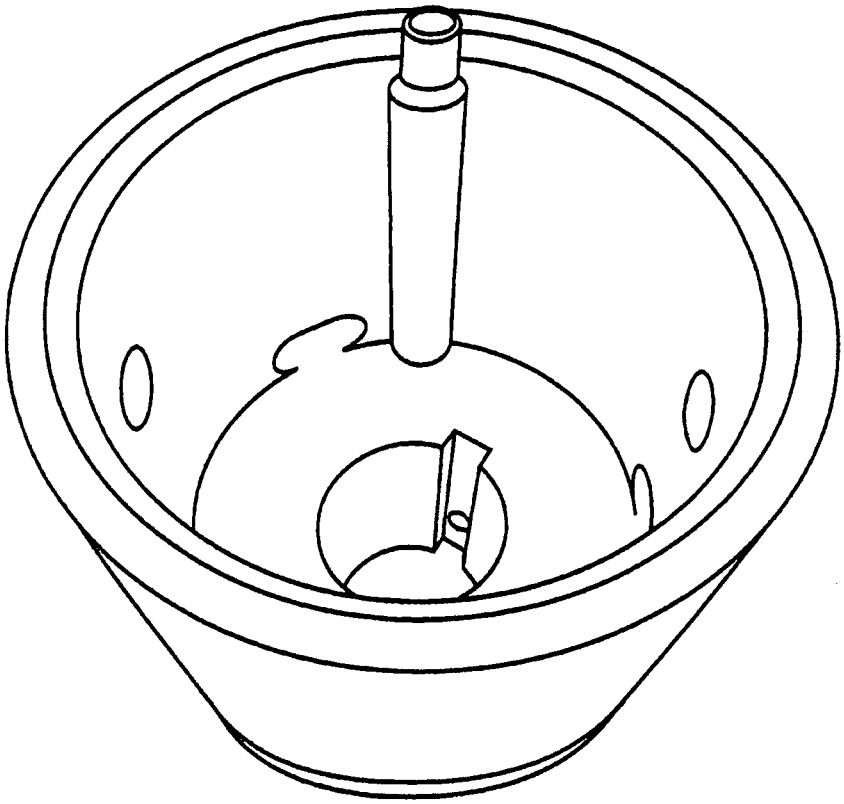
FIG. 9 is a close up view of the coupling of FIG. 8.
Figure 10:
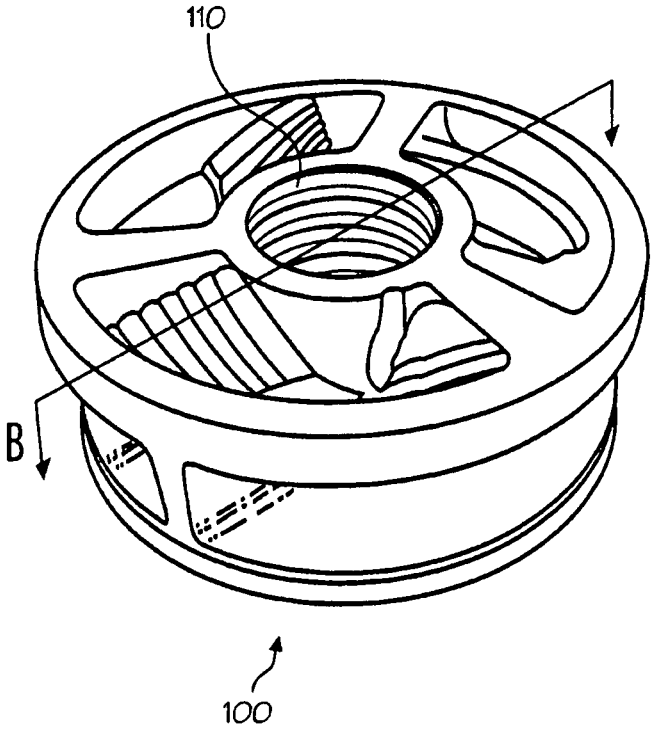
FIG. 10 is a device that may be used as a rotor in the practice of the invention.
Figure 11:
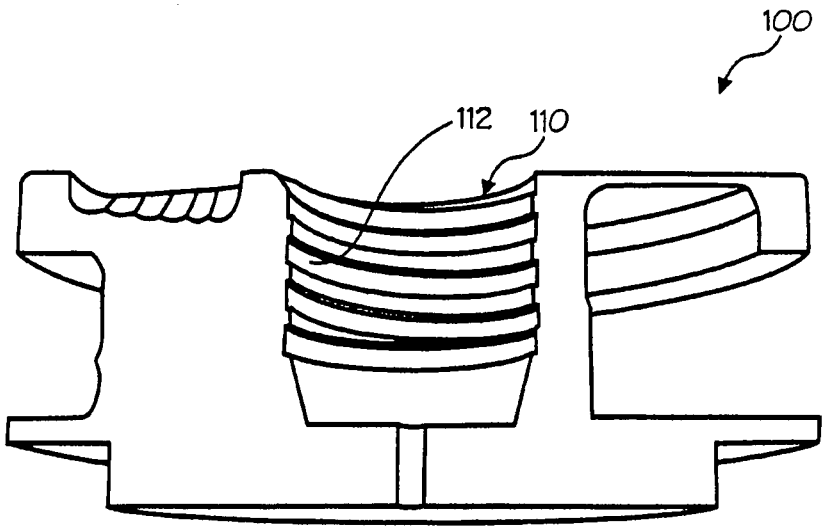
FIG. 11 is a cross-sectional view of the device of FIG. 10 taken along line B-B.
Figure 12:
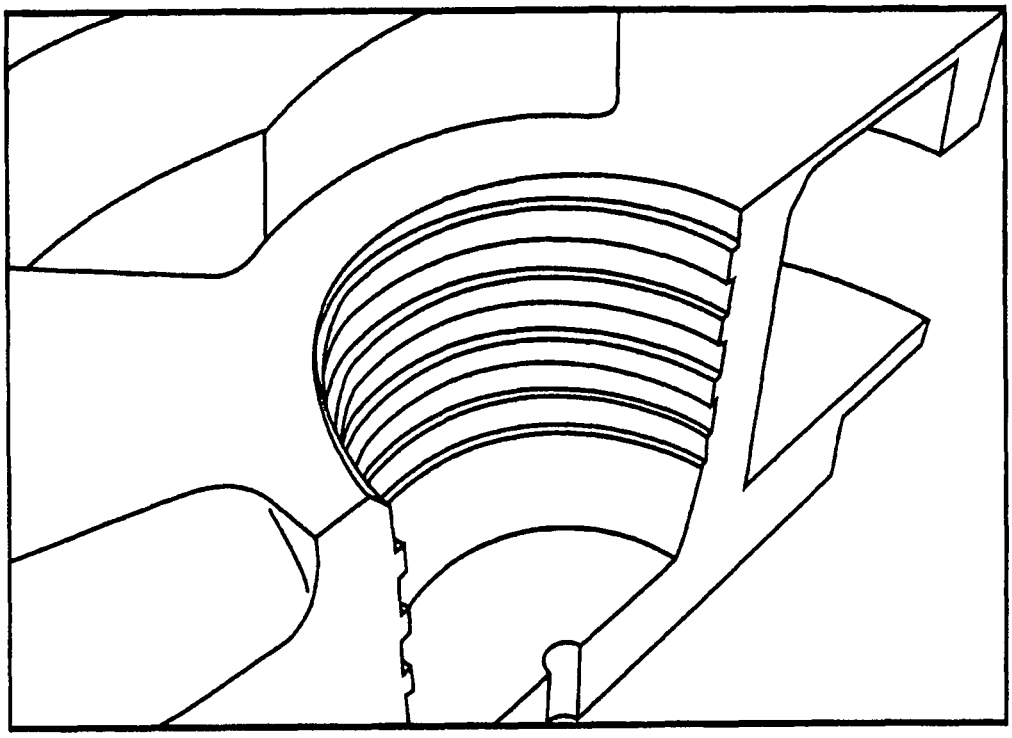
FIG. 12 is a partial, perspective view of the cross-section of FIG. 11.
Figure 13:
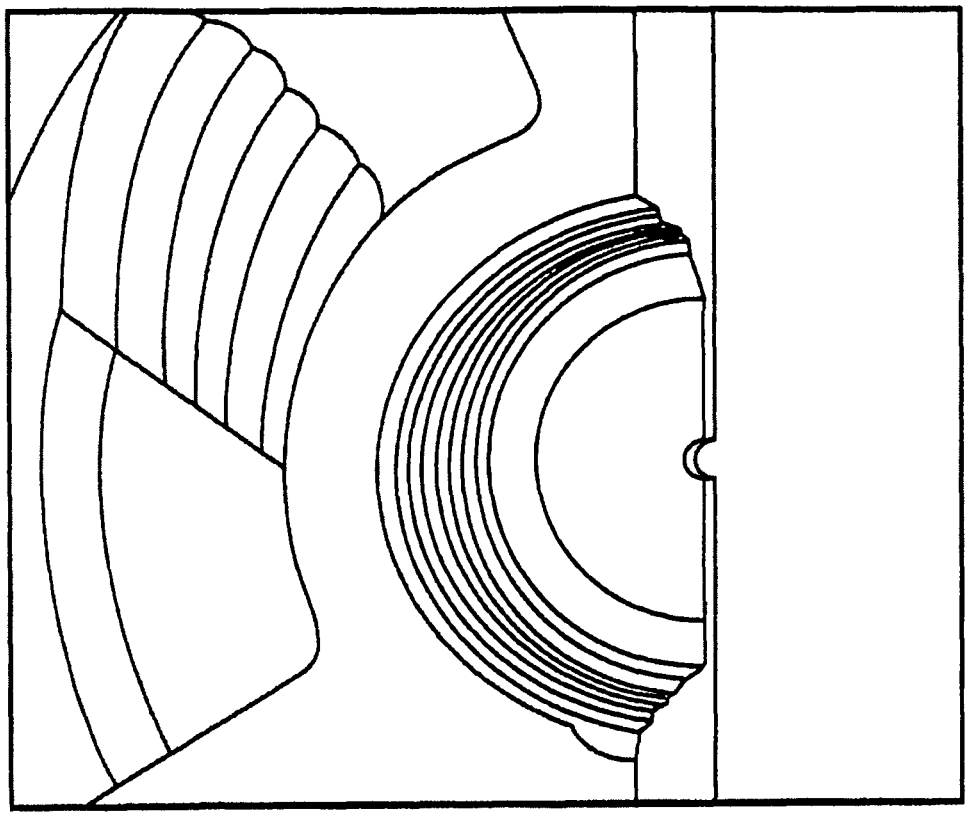
FIG. 13 is a partial, top view of the cross-section of FIG. 11.

As shown in FIG. 1*a*, chamber 26 includes a top opening 28, bottom opening 29, and wall 31. Base 24 further includes a tangential discharge 30 (although another type of discharge, such as an axial discharge may be used) in fluid communication with chamber 26. Base 24 has sides 112, 114, 116, 118 and 120 and a top surface 110. The top portion of wall 31 is machined to receive a bearing surface, which is not yet mounted to wall 31 in this figure. The bearing surface is typically comprised of ceramic and cemented to wall 31.

One or more support posts 34 connect base 24 to a superstructure 36 of pump 20 thus supporting superstructure 36, although any structure or structures capable of supporting superstructure 36 may be used. Additionally, pump 20 could be constructed so there is no physical connection between the base and the superstructure, wherein the superstructure is independently supported. The motor, drive shaft and rotor could be suspended without a superstructure, wherein they are supported, directly or indirectly, to a structure independent of the pump base.

In the preferred embodiment, post clamps 35 secure posts 34 to superstructure 36. A preferred post clamp and preferred support posts are disclosed in a copending application entitled "Support Post System For Molten Metal Pump," invented by Paul V. Cooper, and filed on Feb. 4, 2004, the disclosure of which is incorporated herein by reference. However, any system or device for securing posts to superstructure 36 may be used.

A motor 40, which can be any structure, system or device suitable for driving pump 20, but is preferably an electric or pneumatic motor, is positioned on superstructure 36 and is connected to an end of a drive shaft 42. A drive shaft 42 can be any structure suitable for rotating an impeller, and preferably comprises a motor shaft (not shown) coupled to a rotor shaft. The motor shaft has a first end and a second end, wherein the first end of the motor shaft connects to motor 40 and the second end of the motor shaft connects to the coupling. Rotor shaft 44 has a first end and a second end, wherein the first end is connected to the coupling and the second end is connected to device 100 or to an impeller according to the invention.

The preferred rotor is device 100 as disclosed in the previously-described copending application entitled "Pump with Rotating Inlet."

Rotor shaft 44, best seen in FIGS. 1-6, has an annular outer surface 46, is preferably comprised of graphite, although any shape, size and material suitable for use in a molten metal pump may be used, has a first end 48 and a second end 50. First end 48 preferably includes a vertically extending keyway 52 suitable for transferring driving force to rotor shaft 44. Keyway 52 is preferably vertical, has a width of about ¾" and a depth of about ⅜" and a length of about 4". Keyway 52 is preferably formed on a milling machine using a ¾" diameter bit or tool. As used herein with respect to keyway 52, the term "vertical" or "vertically-extending" means any keyway parallel to longitudinal axis Y of shaft 44 or having an angle up to 45 degrees from being parallel with axis Y. Moreover, any width, depth and length keyway may be used that is capable of supplying adequate rotational force to shaft 44. Keyway 52, however, should not have a depth greater than ÿ the diameter of shaft 44 nor should it have a width greater than about 3", because keyway 52 should not significantly weaken shaft 44.

Shaft 44 may also include multiple keyways, in which case the dimensions of each of the keyways need be sufficient to provide, in the aggregate, adequate driving force to rotor shaft 44. Any rotor shaft described or claimed herein that has "a keyway" refers to a rotor shaft having at least one keyway.

A through-bolt hole 53 is included at end 48 of rotor shaft 44. Hole 53 is preferably ½" in diameter, although any suitable diameter may be used. The purpose of through-bolt hole 53 is to receive a bolt (not shown) that locates rotor shaft 44 in the proper location relative pump base 26 and any suitable structure that provides this function may be used.

Rotor shaft 44 has an optional ceramic sleeve 56, which helps to prevent shaft 44 from being broken.

Shaft 44 also has a second end 50 that includes shallow, flat threads 54. The preferred threads on shaft 54 (and the preferred threads on rotor 100) preferably have a width W of about 0.495" and a height X of about 0.100" and the grooves that receive the threads have a width W1 of about 0.505" and are about 0.005"-0.010" deeper than the height X of the thread. The threads thus have a spacing of about one thread per inch. The threads preferably are flat, are not tapered outward and second end 50 preferably, but not necessarily, has a tapered portion that helps to properly locate end 50 in connective portion 110 of rotor 100, do not end in a point, which further helps to alleviate breakage.

A preferred coupling 200 is made of steel, although any suitable material may be used, has a first coupling member 202 for receiving and being connected to an end of motor shaft 40 and member 202 may be any structure suitable for this purpose, although it is preferred that the connection is made using one or more set screws or bolts (not shown) that are threaded through openings 203. A second coupling member 204 is preferably cylindrical and includes a cavity 206 for receiving first end 48 of rotor shaft 44. Cavity 206 preferably has an annular inner wall 208 and apertures 210 though which a through bolt (not shown) is passed. A projection 212 is preferably steel and is dimensioned to be received at least partially in keyway 52 such that it can provide driving force to rotor shaft 44. In this embodiment, projection 212 is a ¾" diameter steel rod embedded approximately halfway in to annular wall 206, and is about 3"-4" in length. Projection 212 may be attached or connected to member 204 in any suitable manner, such as by welding. Projection 212 applies driving force to rotor shaft 44 as coupling 200 turns.

Rotor 100, shown in FIGS. 10-13, has a connective portion 110 that includes a threaded bore 112 for receiving end 50. Bore 112 includes flat, shallow threads 112 that mate with threads 54 of end 50. Any rotor design, however, having a suitable connective portion may be utilized. Alternatively, a shaft according to the invention may have a first end including flat, shallow threads for connecting to a coupling. In that case, the coupling would have a cavity for receiving the first end of the rotor shaft wherein the cavity would include flat, shallow threads that would mate with the threads on the first end of the rotor shaft. Moreover, the first end of the rotor shaft may have a keyway and some threads.

Alternatively, a shaft according to the invention may have just a first end with flat, shallow threads, just a second end with flat, shallow threads or just a first end with a keyway, or a first end with flat, shallow threads and a second end with flat, shallow threads.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof.

Unless expressly stated in the written description or claims, the steps of any method recited in the claims may be performed in any order capable of yielding the desired product.

What is claimed is:

1. A rotor shaft for use in a molten metal pump, the rotor shaft comprising:

graphite;

an annular, outer surface;

a diameter;

a first end for connecting to a coupling that couples the rotor shaft to a motor shaft; and a second end for connecting to a rotor of the molten metal pump, the second end having threads for being threadingly received into an opening in the rotor;

wherein the first end of the rotor shaft is comprised of graphite, includes a vertically-extending keyway formed in the annular, outer surface, the keyway comprising a groove that is ⅓ or less the diameter of the rotor shaft, the groove configured for receiving a projection attached to and extending from an inner wall of the coupling, whereby the projection can apply driving force to the rotor shaft through the keyway; and wherein the rotor shaft is configured to be removed from the coupling in order to replace the rotor.

2. The rotor shaft of claim 1 wherein the first end does not include threads.

3. The rotor shaft of claim 1 wherein the keyway has a length of 3"-4".

4. The rotor shaft of claim 1 wherein the keyway has a depth of ⅜".

5. The rotor shaft of claim 3 wherein the keyway has a depth of ⅜".

6. The rotor shaft of claim 1 wherein the rotor shaft has a longitudinal axis and the keyway is formed at a 45 degree angle relative the longitudinal axis.

7. The rotor shaft of claim 1 wherein the second end includes flat, shallow threads to connect to the rotor.

8. The rotor shaft of claim 1 that further includes a ceramic sleeve.

9. The rotor shaft of claim 1 wherein the second end includes a taper for centering the shaft in a bore in the rotor.

10. The rotor shaft of claim 7 wherein the second end includes threads that are about 0.495" wide and 0.100" deep.

11. The rotor shaft of claim 7 wherein the threads are not pointed.

12. The rotor shaft of claim 10 wherein the threads are not pointed.

13. A rotor shaft for use in a molten metal pump, the rotor shaft comprising:

graphite;

an annular, outer surface;

a diameter;

a first end for being received in a coupling that couples the rotor shaft to a motor shaft;

a second end for connecting to a rotor of the molten metal pump;

the first end of the rotor shaft including a vertical keyway means formed in the annular, outer surface, the keyway means extending into the rotor shaft up to ⅓ or less of the rotor shaft diameter, the keyway means configured for receiving a projection attached to and extending from an inner wall of the coupling whereby the projection can apply driving force to the rotor shaft;

and wherein the rotor shaft is configured to be removed from the coupling in order to replace the rotor.

14. The rotor shaft of claim 13 wherein the keyway means has a length of between 3"-4".

15. The rotor shaft of claim 13 wherein the rotor shaft has a longitudinal axis and the keyway means is formed parallel to the longitudinal axis.

16. The rotor shaft of claim 13 wherein the keyway means has a depth of ⅜".

17. The rotor shaft of claim 1 wherein the keyway extends along the longitudinal axis.

18. The rotor shaft of claim 1 wherein the keyway is 3" or less in width.

19. The rotor shaft of claim 1 that includes at least one other keyway.

20. The rotor shaft of claim 8 wherein the ceramic sleeve is beneath the keyway.

21. The rotor shaft of claim 1 that further included a through-bolt hole that vertically aligns the shaft.

22. The rotor shaft of claim 13 wherein the first end does not include threads.

* * * * *